United States Patent [19]

Patel et al.

[11] 4,009,682

[45] Mar. 1, 1977

[54] WEB DISPENSER

[75] Inventors: Savinay Patel, Roselle; Bernard F. Szuhaj, Lombard, both of Ill.

[73] Assignee: Central Soya Company, Inc., Fort Wayne, Ind.

[22] Filed: Apr. 19, 1976

[21] Appl. No.: 678,157

[52] U.S. Cl. ..... 118/118; 68/5 E; 118/420; 206/.5

[51] Int. Cl.[2] ..... B05C 11/02

[58] Field of Search ..... 118/419, 50, 118, 119, 118/420, 405, DIG. 19, 49, 49.1, DIG. 22, 123–126; 34/242; 68/5 E; 221/1; 128/90, 91; 33/86, 87; 312/37, 38, 40; 206/205, .5, 409; 225/106; 427/355

[56] References Cited

UNITED STATES PATENTS

| | | | |
|---|---|---|---|
| 3,025,205 | 3/1962 | Young | 118/420 X |
| 3,140,594 | 7/1964 | Carter | 68/5 E |
| 3,328,982 | 7/1967 | Mylo | 68/5 E |
| 3,645,116 | 2/1972 | Peter | 68/5 E |
| 3,749,296 | 7/1973 | Harrison | 225/106 |
| 3,808,845 | 5/1974 | Lopata | 68/5 E |

*Primary Examiner*—Morris Kaplan
*Attorney, Agent, or Firm*—Tilton, Fallon, Lungmus, Chestnut & Hill

[57] ABSTRACT

A web dispenser wherein an elongated coated web is dispensed from a container by manually pulling the same through a closely confined rotatable ball closure whereby the coating is metered.

4 Claims, 3 Drawing Figures

WEB DISPENSER

BACKGROUND AND SUMMARY OF INVENTION

This invention realtes to a web dispenser and, more particularly to a device for dispensing or extracting a web which may carry a useful material such as a fluid. For example, premoistened, tissue-like material has been available for many years in the form of packets such as moisture proof envelopes. More recently, such tissue has been provided in bulk form in a container having a dispensing closure equipped with a contoured slit — see, for example, U.S. Pat. Nos. 3,749,296 and 3,868,052. The dispensing closures of the art have suffered from the drawback of requiring specialized techniques in dispensing, i.e., requiring specialized techniques in dispensing, i.e., requiring that the towelette material be pulled in a specific direction and/or in a specific manner. More importantly, no one in the web dispensing art saw fit to use a caged-ball type of dispenser — notwithstanding the fact that these are widely used, as in roll-on deodorants.

The roll-on type dispensers have been limited to dispensing fluid materials and efforts have been concentrated to make them leakproof. This also helped to prevent evaporation of the material from the containers. The fitment cap and the roller ball had to be of exacting dimensions with a very narrow clearance between the fitment and the ball.

The instant invention gets away from the previous ideas by changing the dimensions of the roller ball and the cap where larger clearance is allowed between fitment cap and the ball to allow the web to pass through. The ball is used to lock in, hold and dispense the web and guide it in the upward direction acting as pop-up valve for the web material. The gentle drag becomes smooth on pulling the moist web as the ball rolls and the continuous squeezing action on the moist web material provides lubricating fluid decreasing the friction on the ball.

An advantage of the invention is the way in which the dispensing system is put together. The fitment cap is of such a configuration and dimension that it allows the ball to snap in the position from the bottom. The support mechanism is so constructed that it allows the degree of freedom of rotation on the ball at the same time narrow enough that the ball could not snap out on pulling the web for dispensing. Further advantageously, the moist tissue material is inserted through the fitment clearance and then the ball is snapped in position in that sequence. The web material may be cut, slotted or perforated at spaced intervals. The web material may be moistened, or coated, with water, alcohol, emulsions pharmaceutical preparations, ointment, vegetable oils, creams, hand lotions, vaseline and the web material may be selected from a variety of materials such as non-woven fabrics, woven fabrics, i.e., cotton, nylon and other plastic webs.

DETAILED DESCRIPTION

The invention is described in conjunction with an illustrative embodiment in the accompanying drawing in which.

Figure 1:
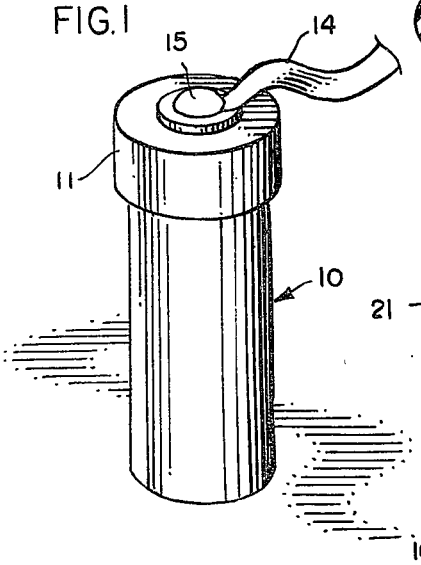
FIG. 1 is a perspective view of an embodiment of the invention.
Figure 2:
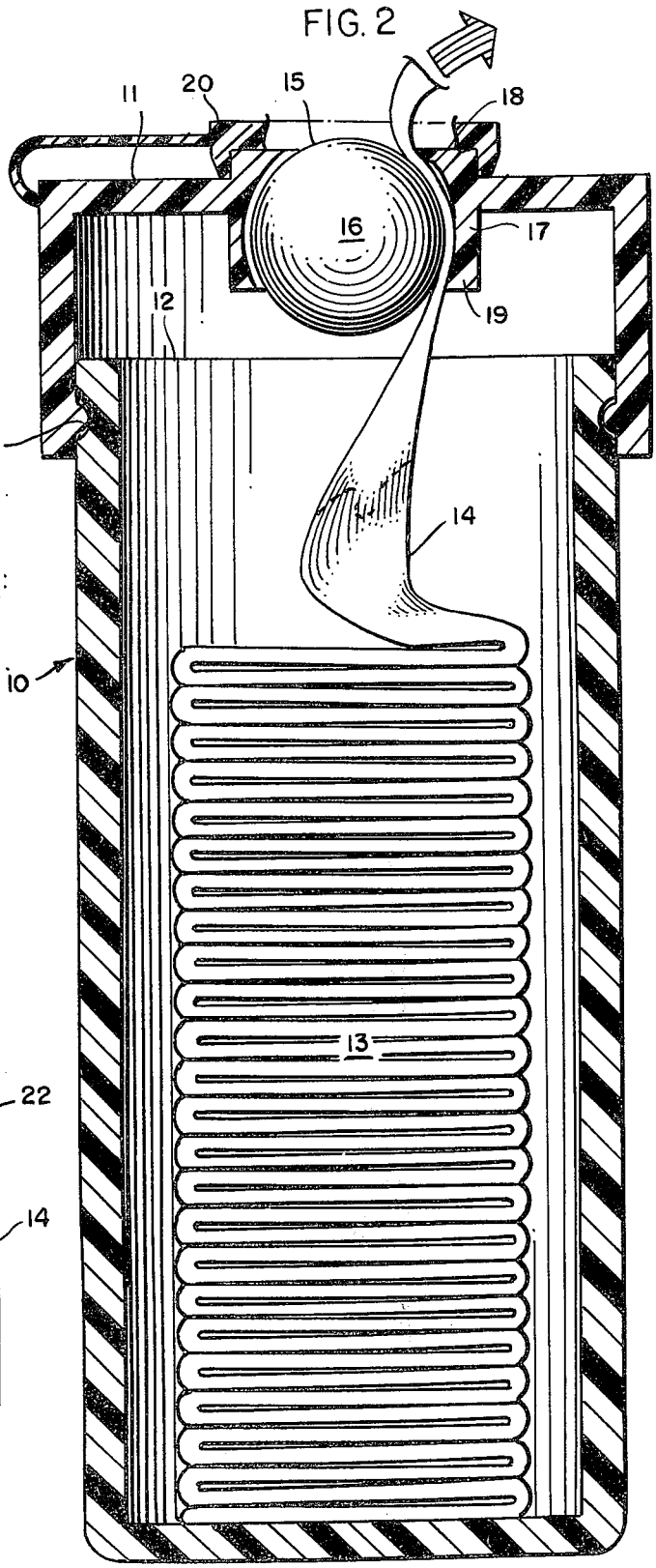
FIG. 2 is an enlarged typical sectional view of the device seen in FIG. 1 and with a suitable cap shown in fragmentary dotted line form.

In the illustration given, and with reference first to FIG. 1, the numeral 10 designates generally a dispensing container which is equipped with a closure member 11 closing the open mouth 12 (see FIG. 2). An elongated web 13 is seen stacked in zig-zag folded form (see FIG. 2) within the container 10 and a tail portion as at 14 is seen in the process of being dispensed through the closure 11.

The closure 11 is apertured as at 15 and provides a cage or holder for a ball 16. The tail or unfolded portion 14 of the web 13 is pulled through the aperture and around the ball 16, tending to rotate the same to facilitate the dispensing.

In the illustration given, the aperture 15 is defined by a generally cylindrical wall 17 which is contoured on its inner face to be a segment of a sphere and thus generally conform to the exterior of the ball 16. At its upper end, the wall 17 is equipped with an integral flange-like portion 18 which is sized, i.e., extend sufficiently inwardly so as to prevent ejection of the ball 16 during the manual pulling of the web portion 14.

The wall 17 additionally is equipped with an integral inwardly extending flange portion at the bottom thereof as at 19 (and thereby spaced from the flange portion 18) which is sized so as to permit passage of the ball 16 upon flexure of ether the ball 16 or the wall 17. In the illustration given, the ball 16 is relatively rigid whereas the wall 17 is constructed of more resilient material so that loading is readily accomplished by first threading the web portion 14 through the aperture 15 and thereafter snapping the ball 16 into the cage-like aperture 15. It will be appreciated that the forces exerted on the ball 16 do not tend to dislodge it inwardly but rather tend to move it outwardly against the retaining flange or lip portion 18.

The container 10 is employed to contain and hold the web material in a variety of forms, wound, folded, etc. The web material can be advantageously employed as a carrier by impregnation, coating, or the like. For example, the web material can be moistened after insertion thereof into the container 10. Alternatively, it may be precoated and then placed in the container. Should a fluid material be placed in the container 10, a snap-on cap 20 (see FIG. 2) may be used to advantage to insure confining the liquid contents. The closure 11 can be secured to the container 10 — as by snap-on fitting 21 (still referring to FIG. 2). Alternatively, thread type closures are equally suitable.

Figure 3:
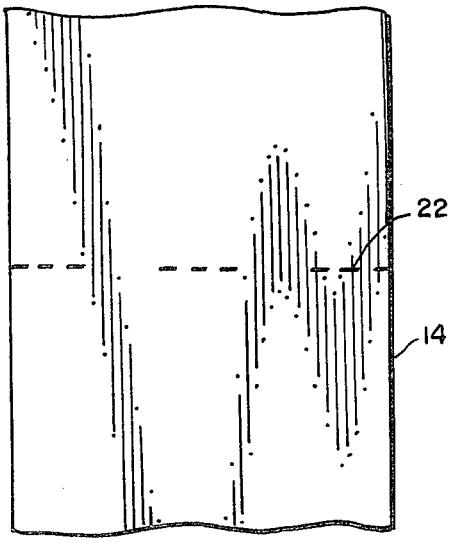
FIG. 3 is a fragmentary elevational view of a web showing a potential line of severance therein.

Referring now to FIG. 3, a segment of the web tail 14 is seen to be equipped with a line of potential severance 22. The line of potential severance may be provided by folding, creasing, scoring, slitting or perforating as shown. Advantageously, the tensile strength of the web is related to the mounting of the ball in the cage provided by the wall 17 to permit pulling the web through the clearance between the ball and the aperture without severing the web while a line of potential severance is in the clearance. More particularly, should the line of potential severance be in the form of slits or perforations, the strength of the remaining bonds are such as to provide sufficient strength to resist the tearing effect of the friction developed during the manual pulling of the web. A wide variety of materials may be used to advantage — the three principal materials being used in this environment being cotton, nylon or non-woven fabric because of their inexpensiveness of manufacture for disposable purposes. These materials are particularly suited for carrying a wide variety of fluid materials. In general, they are considered absorbent but not subject to substantial diminution of structural integrity upon wetting, as is the case with many paper products.

As used herein, the term "fluid" can refer to a wide variety of materials carried by, coated on, or impregnated in the web. The fluid material can be water, alcohol, vegetable oils, ointment, pharmaceutical preparations, vaseline, hand creams and lotions, furniture and floor polish and petroleum jellies or foams and soap solutions, emulsions made up of water, alcohol, vegetable oil and like material. Each of these materials can serve as an advantageous lubricant for the ball to impart rotation thereto while the web 14 is being extracted from the closure 11. At the same time, the ball 16 squeezes the web material so as to limit any excess fluid material from being extracted, i.e., serving, in effect, as a "squeegee". It has been found that even where the surface of the ball is dry, rotation is quickly established in a relatively frictionless manner after only a short portion of the web 14 has been pulled through the annular opening between the wall 17 and the ball 16. Thereafter, jerking the web while pulling separates the individual pieces of web along the lines of potential severance.

As pointed out previously, the ball 16 is advantageously snapped into the cage provided by the wall 17 through the provision of the wall 17 being constructed of a somewhat resilient material. As illustrated, the bottom opening to the aperture 15 is larger than the upper opening but smaller than the diameter of the ball 16.

I claim:

1. A towelette dispenser comprising a container having an open mouth, an elongated web of material in said container, a dispensing closure for said container, said closure including an apertured member closing said open mouth, a ball mounted in said aperture and rotatable therein to pass said web around said ball upon manual pulling of said web, said web being equipped with transversely extending lines of potential severance, said web having a tensile strength so related to the mounting of said ball in said aperture to permit pulling said web through the clearance between said ball and aperture without severing said web while a line of potential severance is in said clearance, said closure aperture being defined by a wall providing upper and lower spaced apart inwardly extending ball retaining flanges, said upper flange being sized to prevent passage of such ball upon application of said manual pulling, said container including a liquid material therein disposed to coat or impregnate said web, and said ball in conjunction with said aperture defining means metering the liquid being carried by said web passing therebetween.

2. The structure of claim 1 in which said web is a member selected from the class of cloth, woven fabrics, non-woven fabrics and plastic webs.

3. The structure of claim 1 in which one of said ball and wall is constructed of resilient material while the other is substantially rigid.

4. The structure of claim 1 in which said closure includes a cap member for sealing said aperture.

* * * * *